US005285734A

United States Patent [19]

MacPherson

[11] Patent Number: 5,285,734

[45] Date of Patent: Feb. 15, 1994

[54] SECURITY ENCLOSURES

[75] Inventor: Hugh MacPherson, Fife, Scotland

[73] Assignee: W. L. Gore & Associates (UK) Ltd., London, United Kingdom

[21] Appl. No.: 915,482

[22] Filed: Jul. 16, 1992

[30] Foreign Application Priority Data

Jul. 24, 1991 [GB] United Kingdom ..... 9115972.3

[51] Int. Cl.[5] ..... G08B 13/00

[52] U.S. Cl. ..... 109/42; 340/550; 428/915; 428/916; 206/459.1; 206/807; 109/38

[58] Field of Search ..... 109/31-38, 109/40, 41, 42, 49.5; 340/550 X; 361/398; 428/915 X, 916 X; 206/459.1 X, 807 X

[56] References Cited

U.S. PATENT DOCUMENTS

| | | | |
|---|---|---|---|
| 181,078 | 8/1876 | Larned | 109/41 |
| 3,594,770 | 7/1971 | Ham | 174/105 R |
| 4,785,743 | 11/1988 | Dalphin . | |
| 4,972,175 | 11/1990 | MacPherson . | |
| 5,014,162 | 5/1991 | Clark et al. | 361/412 |

FOREIGN PATENT DOCUMENTS

| | | | |
|---|---|---|---|
| 598272 | 7/1988 | Australia . | |
| 277679 | 8/1988 | European Pat. Off. . | |
| 347209 | 12/1989 | European Pat. Off. . | |
| 1375926 | 12/1974 | Fed. Rep. of Germany . | |
| 8300246 | 1/1983 | World Int. Prop. O. | 340/550 |
| WO87/06749 | 11/1987 | World Int. Prop. O. . | |

*Primary Examiner*—Peter M. Cuomo
*Assistant Examiner*—Darnell M. Boucher

[57] ABSTRACT

There is disclosed a security enclosure including a folded, flexible, electrically insulating sheet extending over the whole of the area of the enclosure and carrying lines of electrically responsive material on each side, the lines defining a conductor extending over both sides of the sheet, electrical connections between lines on one side of the sheet and respective lines on the other side of the sheet being provided by line connections extending through the sheet and at selected edges of the sheet the line connections being spaced inwardly of the edge and separated from the edges by a respective line-carrying portion of sheet. The enclosure includes a circuit for detecting a change in an electrical characteristic of the conductor caused by an attempt to penetrate the sheet.

18 Claims, 10 Drawing Sheets

SECURITY ENCLOSURES

FIELD OF THE INVENTION

This invention relates to security enclosures, and more particularly to security enclosures for giving warning, or destroying or erasing information, if interference is made with the enclosure with the aim of gaining access to an object within the enclosure. The invention also relates to sheets and laminates for use in making such enclosures, and to methods of making such enclosures. The invention has particular application to security enclosures havings walls formed of flexible laminate which has been folded to form the enclosures.

BACKGROUND OF THE INVENTION

It is known to provided security enclosures with walls or sheets incorporating coils, meshes or grids of electrically responsive material and to monitor certain electrical characteristics of the material to provide an indication when the sheet containing the material has been pierced or an attempt has been made to open the enclosure through other means. Detection of such an attempt may activate an alarm, destroy the material or object within the enclosure, or erase information if the object within the enclosure, for example, contains sensitive magnetically recorded information. Examples of such enclosures are disclosed in PCT International Application Publication No. W087/06749 to Wolf, U.K. Patent No. 1,375,926 to GAO Gesellschaft Fur Automation und Organisation mbH, U.S. Pat. No. 4,785,743 to Dalphin and European Patent Publication No. 277,679 to Seculock BV. However, the present invention is more closely related to security enclosures of the form disclosed in U.K. Patent Application GB 2220513A, to W. L. Gore and Associates Inc. The disclosed security enclosures are formed from layers of flexible material including a matrix of diagonally extending semi-conductive lines printed on to a rectangular, thin insulating film. The matrix of lines forms a continuous conductor which is broken if attempts are made to penetrate the film. The circuit is monitored by opening the conductor at one point and measuring the change of resistance between the two ends of the circuit.

The Gore application discloses enclosures in the form of shallow, rectangular envelopes formed simply by folding a rectangular laminate, including the various layers of flexible material and the matrix of diagonally extending semi-conductive lines, about a single axis and then securing the edges of the laminate to one another to form the envelope.

Although the disclosed laminate is flexible, it is nevertheless considered preferable to minimize the number of folds required in the formation of the enclosure, as the semi-conductive lines which define the matrix can be damaged through folding. Thus, enclosures formed in this way are not well suited for containing objects that are not relatively thin and flat.

SUMMARY OF THE INVENTION

According to one aspect of the present invention there is provided a laminate for use in forming security enclosures comprising: a flexible, electrically insulating sheet carrying lines of electrically conductive material on each side, the lines defining a conductor extending over both sides of the sheet, electrical connection between lines on one side of the sheet and respective lines on the other side of the sheet being provided by line connections extending through the sheet, and at least one edge of the laminate the line connections being spaced inwardly from the edge of the laminate and separated from the edge by a line-carrying portion of sheet, an attempt to penetrate the laminate resulting in damage to the lines and changing a detectable electrical characteristic of the conductor; and means for connecting the conductor to means for detecting such changes.

Preferably, the laminate includes a line carrying core portion and a line carrying extension portion at an edge of the core portion, the core portion having lines on one side of the sheet connected to lines on the other side of the core portion through line connections and also having lines connected to lines on the extension portion. Most preferably, the extension portion also has line connections between lines on one side of the extension portion and the lines on the other side of the extension portion.

In use, the laminate may be folded and formed into an enclosure, at least some of the folds in the laminate being formed between the edges of the core and extension portions. It is preferred that a plurality of conductors are provided and once the laminate is formed into an enclosure, the electrical characteristic of each conductor is individually monitored, through the conductor connecting means, and changes in the electrical characteristic caused by attempted penetration through the sheet will, for example, sound an alarm or destroy or erase information contained on an object within the enclosure.

Preferably also, the line connections are in the form of apertures extending between overlapping lines with electrically conductive material extending through the apertures to connect the lines. In a preferred embodiment, the lines are formed by printing semi-conductive ink on the sheet, and when the ink is printed over an aperture the ink forms a conductive lining on the aperture wall.

The edge of the core portion is preferably straight to facilitate folding to the sheet between the core and extension portions. Depending on the form of the enclosure to be formed from the laminate, extension portions may be provided at a plurality of the edges of the core portion. Most preferably, at least the core portion is rectangular.

The lines provided at the outer edge of the extension portion may be relatively fragile to facilitate detection of attempts to gain entry to an enclosure formed with the laminate by separation of an extension portion from the complementary overlapping portion.

Preferably also, the lines on one side of the sheet extend obliquely relative to the lines on the other side to divide the sheet into a number of relatively small areas. The lines of electrically responsive material are preferably of semi-conductive material and may be straight or wavy.

According to a further aspect of the invention, there is provided a security enclosure comprising: a folded, flexible, electrically insulating sheet extending over the whole of the area of the enclosure and carrying lines of electrically responsive material on each side, the lines defining a conductor extending over both sides of the sheet, electrical connections between lines on one side of the sheet and respective lines on the other side of the sheet being provided by line connections extending through the sheet and at selected edges of the sheet the line connections being spaced inwardly of the edge and separated from the edges by a respective line-carrying portion of sheet; means for detecting a change in an electrical characteristic of the conductor caused by an attempt to penetrate the sheet; and means for connecting the conductor to the detecting means.

Preferably, the sheet includes a line carrying core portion and line carrying extension portions at respective edges of the core portion, the core portion having lines on one side of the sheet connected to lines on the other side of the core portion through line connections and also having lines connected to lines on the extension portions. Most preferably, each extension portion also has line connections between lines on one side of the extension portion and the lines on the other side of the extension portion. At least some of the folds in the sheet may be formed between the edges of the core portion and adjacent extension portions.

Preferably also, a plurality of conductors are formed by the lines and the conductor connecting means are provided at an edge portion of the sheet for individually connecting the conductors to the detecting means. The connecting means may include switch means which may be selectively configured to connect connections associated with the detecting means with selected conductors. The ability to link the individually monitored conductors to different detecting means connections increases the difficulties encountered by a potential intruder in attempting to gain entry to the enclosure.

Preferably also, one edge portion of the sheet includes a plurality of line switch means which are selectively configured to connect each one of the lines on one side of the sheet with a selected one of a plurality of liens on the other side of the sheet. The provision of the lines switch means permits similar enclosures to be provided with sheets on which the configuration of conductors varies, simply by varying the configuration of the line switch means.

According to a still further aspect of the present invention, there is provided a method of forming a security enclosure comprising;

providing a flexible, electrically insulating sheet carrying lines of electrically responsive material on each side, the lines defining a conductor extending over both sides of the sheet, electrical connections between lines on one side of the sheet and respective lines on the other side of the sheet being provided by line connections extending through the sheet, the sheet including a line carrying core portion and line carrying extension portions, each extension portion defining an edge of the sheet and at selected edges of the core portion the line connections being spaced inwardly of the respective adjacent edge of the sheet and separated from said adjacent edge by a respective extension portion;

providing means for detecting a change in an electrical characteristic of the conductor caused by an attempt to penetrate the sheet;

providing means for connecting the conductor to the detecting means;

folding the sheet between the core portion and the extension portions to form an enclosure and such that respective edge portions of the sheet overlap; and fixing the overlapping edge portions of the sheet to one another.

BRIEF DESCRIPTION OF THE DRAWINGS

These and other aspects of the invention will now be described by way of example, with reference to the accompanying drawings, in which.

DETAILED DESCRIPTION OF DRAWINGS

Figure 1:
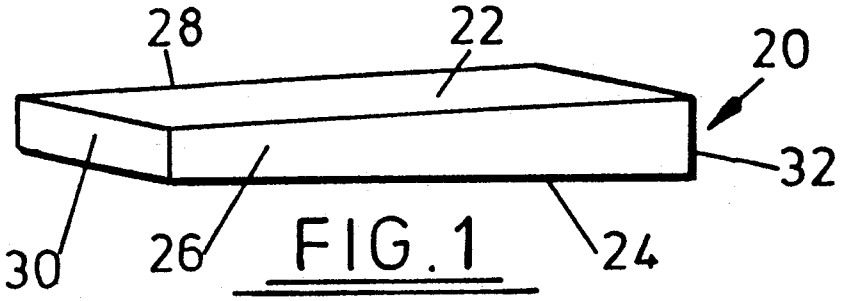
FIG. 1 is a perspective view of a security enclosure in accordance with a preferred embodiment of the present invention.
Figure 2:
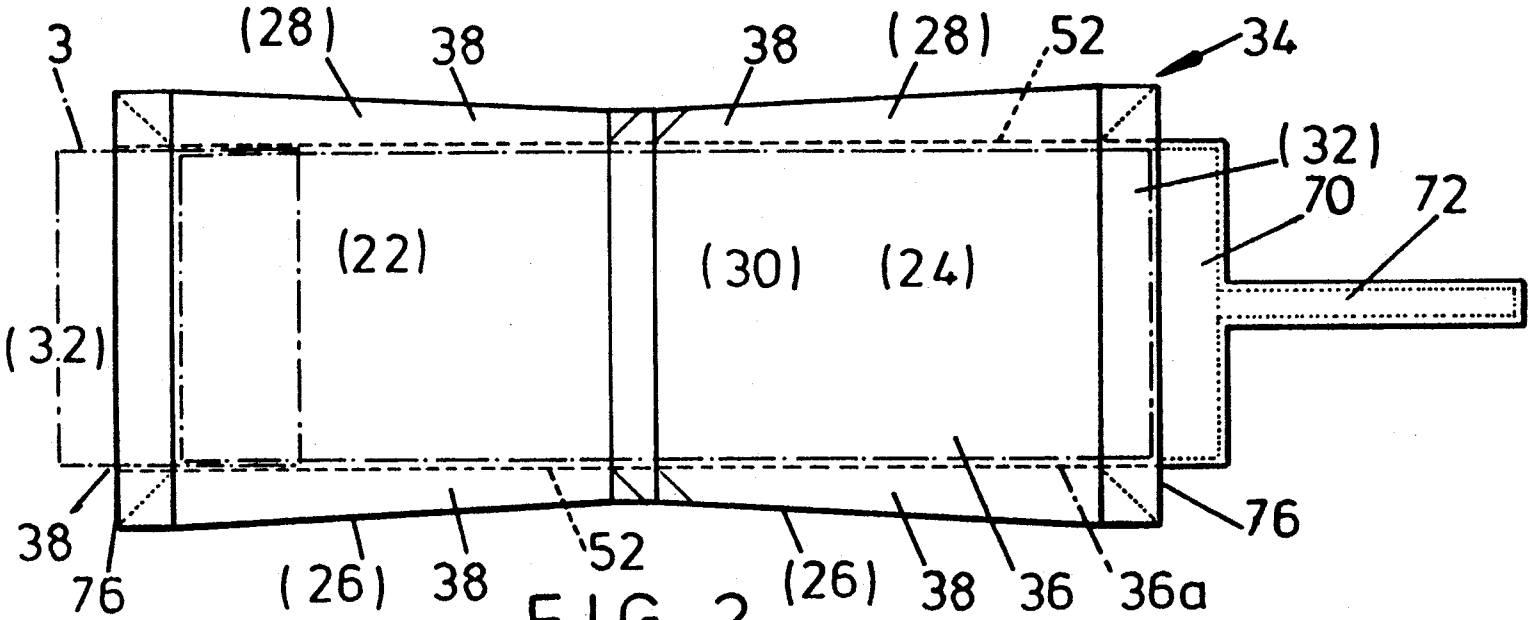
FIG. 2 is a diagrammatic view of the laminate used to form the enclosure of FIG. 1.

Reference is first made to FIG. 1 of the drawings which shows a security enclosure 20 in the form of a truncated wedge shaped box having upper and lower walls 22, 24, side walls 26, 28 and end walls 30, 32. The enclosure 20 comprising a flexible laminate which is formed as a planar sheet and then folded to the desired form. FIG. 2 of the drawing is a diagrammatic view of the laminate 34 used to form the enclosure 20. The parts of the laminate 34 which form the walls of the enclosure 22, 24, 26, 28, 30, 32 are identified by the reference numeral of the particular wall shown in parenthesis.

The laminate 34 comprises various layers which are constructed to detect any attempt to penetrate the enclosure 20. Various electrical characteristic of the laminate 34 are monitored by means of a suitable electrical circuit, as will be described, and any attempt to penetrate the laminate results in a change in an electrical characteristic which is detected and used to activate an alarm, or destroy or erase information from the object contained within the enclosure 20.

Figure 3:
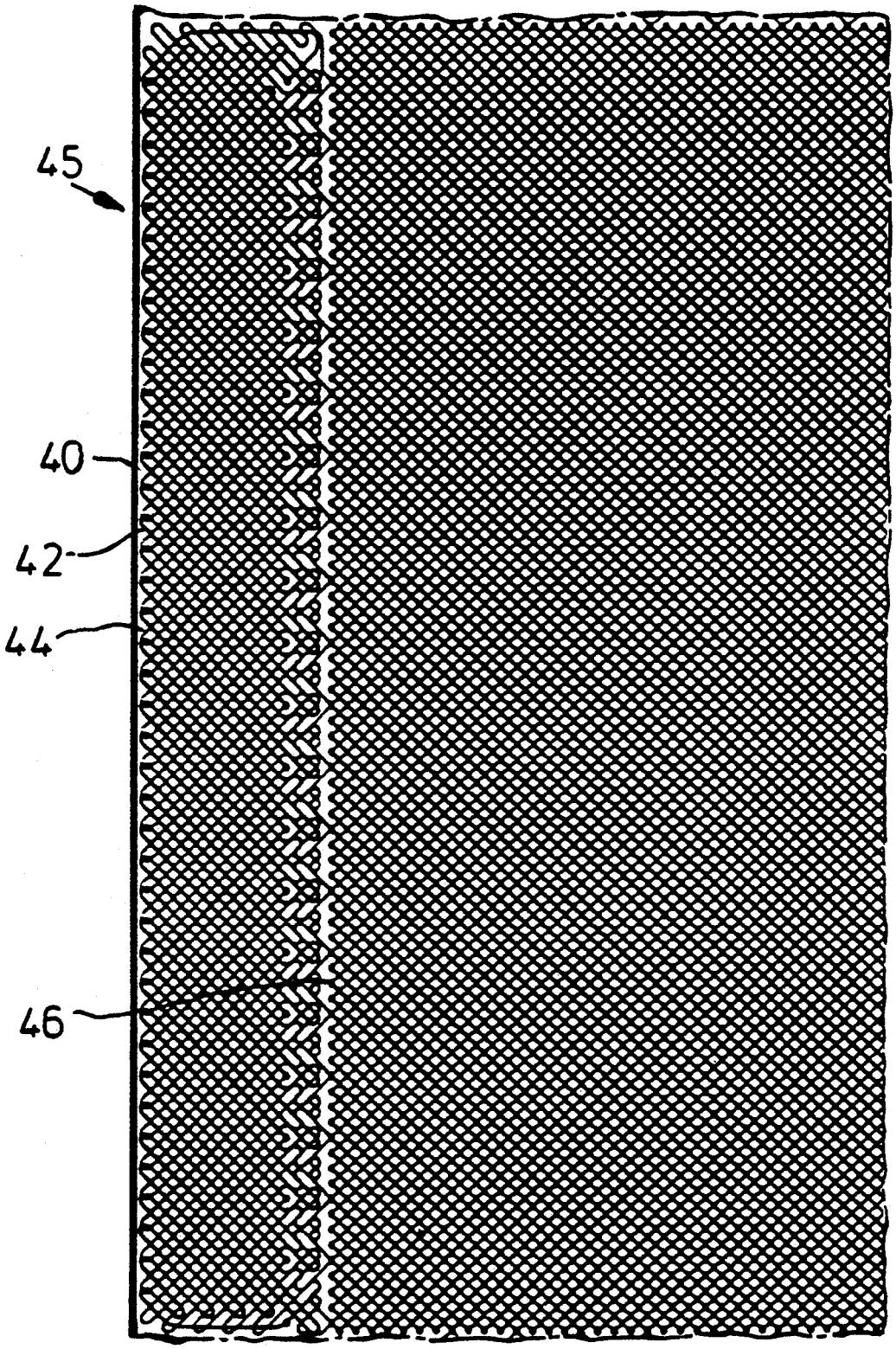
FIG. 3 is an enlarged view of area 3 of FIG. 2.
Figure 4:
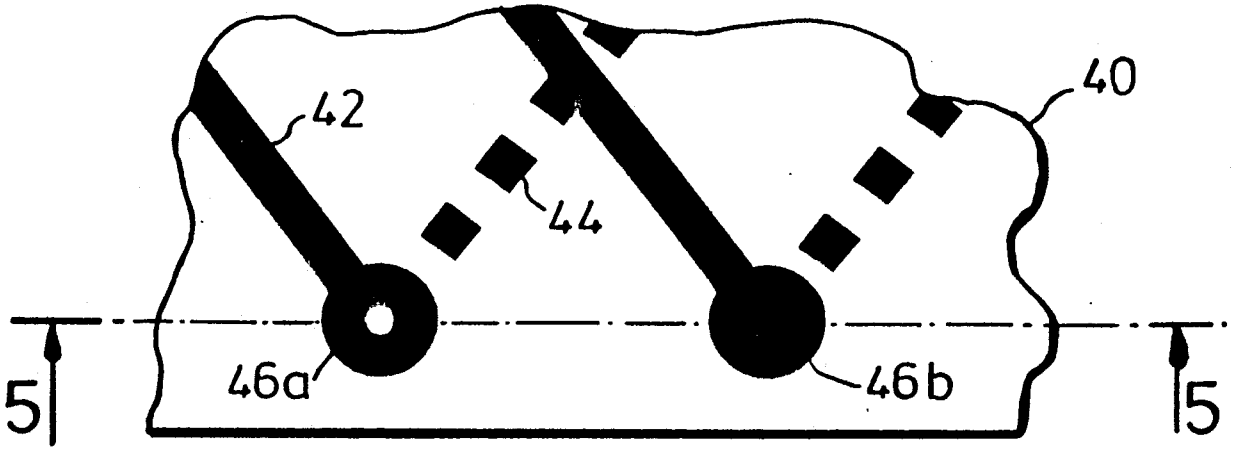
FIG. 4 is an enlarged view of a portion of the edge of a core portion of the laminate of FIG. 3.
Figure 5:
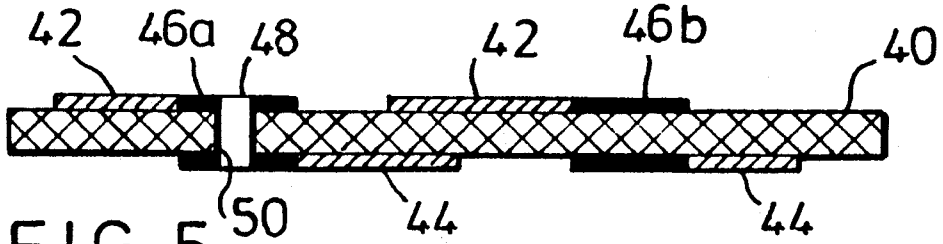
FIG. 5 is a sectional view on lines 5—5 of FIG. 4.

One aspect of the laminate 34, to which the present invention particularly relates, is the provision of a matrix 45 of electrically responsive lines, which are shown in more detail in FIGS. 3 through 7 of the drawings. The matrix is divided into a number of portions; a central, rectangular core portion 36, as defined by the line 36*a* in FIG. 2; and extension portions 38 located at edges of the core portion 36. An edge of the core portion 36 and an extension portion 38 are shown in FIG. 3. The laminate 34 includes a flexible, electrically insulated sheet 40 which carries lines 42, 44 of electrically responsive material on each side. In the preferred construction various other layers of material are provided, and these will be described below with reference to subsequent drawings. In FIG. 3 the lines 42, 44 on both sides of the sheet 40 are shown in solid outline, the lines 42 extending from the bottom right hand corner of the figure towards the upper left hand corner of the figure lying on the upper surface of the sheet 40, while the lines extending from the lower left hand corner to the upper right hand corner lie on the underside of the sheet 40. As noted, the lines 42, 44 extend diagonally across the sheet 40 and the lines on one side extending obliquely relative to the lines on the other side to divide the sheet into a matrix of diamond-shaped areas.

Connections between the lines 42, 44 are provided at pads 46, the majority of which are provided at the edge of the core portion 36, but a number of which also occur in the extension portions 38. Pads are provided on each side of the sheet and two pairs of registering pads 46*a*, 46*b*, may be seen in FIGS. 4 and 5. A connection between the lines is provided at the pads 46*a* by forming a hold 48 through the sheet such that when the lines 42, 44 are formed, preferably by printing, the semi-conductive ink used to form the lines on one side extends through the hold 48 in to contact with the lines on the other side. In practise, the lines are printed on one side of the sheet before the holes are formed. The holes are then punched in the sheet and the connection hole lining 50 is formed when the second set of lines are printed on the other side of the sheet.

It will be seen that the pads 46*b* are devoid of a through hole so that there is no interconnection between the lines at the pads 46*b*.

The matrix of line 42, 44 are so connected to from a number of loops or conductors, which will be broken if an attempt is made to penetrate the laminate, by cutting, abrasion, application of solvents, or application of heat.

Figure 6:
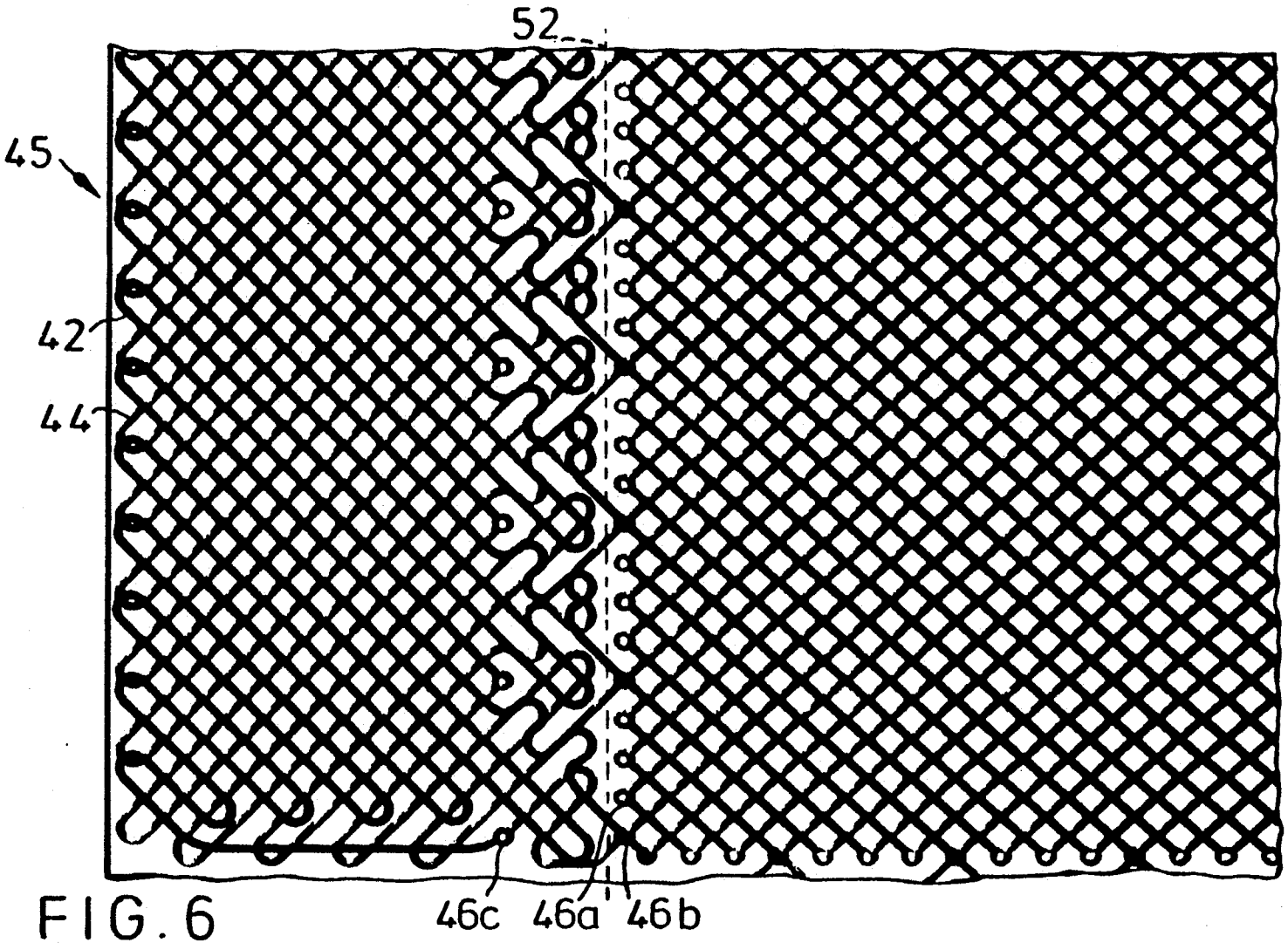
FIG. 6 is a view of an edge of the laminate shown in FIG. 3, shown further enlarged.
Figure 7:
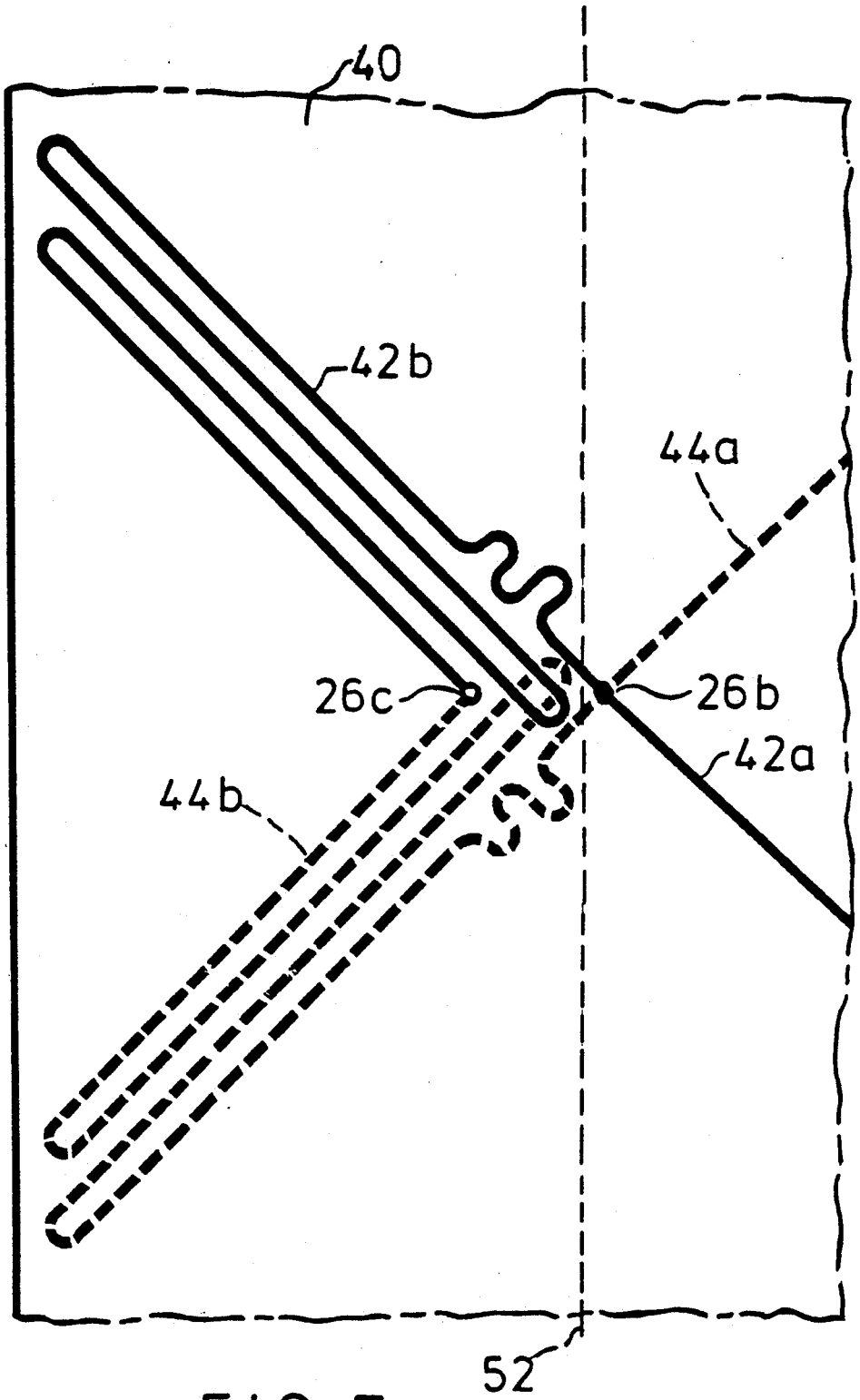
FIG. 7 is a view of a portion of the laminate in FIG. 3, showing selected lines of electrically responsive material.

FIG. 6 of the drawings shows a portion of laminate of somewhat greater detail and it will be noted that, in this particular example, apertures are provided in the majority of pads 46 at the edge of the core portion 36, but at a number of pads 46 (every fourth pad) there is no aperture and the lines continue on to the extension portion 38. On the core portion 36 the individual lines are straight and extend directly between pads at different edges of the core portion 36, whereas on the extension portion 38 the lines include curved portions and extend in various directions, as may be seen more clearly in FIG. 7, in which the line on the upper face of the core portion is indicated as 42*a*, the line on the upper face of the extension portion is indicated at 42*b*, the line on the lower face of the extension portion is indicated as 44*b* and the line on the lower face of the core portion is indicated as 44*a*. The connection between the lines 42*b*, 44*b* on the extension portion 389 is provided through an apertured pad 46*c*, which is spaced outwardly from the inner edge of the extension portion.

When forming the enclosure 20, the laminate 34 is folded along imaginary lines 52, a number of which extend between adjacent core and extension portions (FIG. 2) and the overlapping extension portions which form the side walls 26, 28 and the end wall 32 are overlapped and fixed to one another using adhesive, as will be described.

The location of a number of the fold lines 52 in the area between the core portion 36 and the extension portions 38 reduces the possibility of damage to the less flexible lines 42, 44 as, at the majority of fold lines 52, there are a relatively small number of lines. Also, the flexibility of the laminate is reduced at the apertured pad locations 46*a*, 46*c* such that it is preferred that the fold lines are spaced from the pad locations and that folds do not occur on a pad.

It is a further advantage of the laminate configuration described that the apertured pads are spaced from the edges of the laminate 34. The enclosure 20 may be subject to very sophisticated attack and the apertured pads 46*a*, 46*c* are a relatively vulnerable part of the structure. As the edges of the laminate would be one of the more likely points for attempting to gain entry to the enclosure 20 the pads are thus spaced from the edges and, further, the lines 42*b*, 44*b* provided at the outer edges of the extension portions 38 may be formed of more fragile material, or necked at the edges, such that an attempt to gain entry at the edge will be more likely to result in damage to the lines 42*b*, 44*b*. Also the provision of the separate extension portions 38 allow the use of extension portions provided with an extra fine segmentation pattern at the sealing edges of an enclosure.

The use of a core portion 36 and various extension portions 38 allows the enclosure designer greater flexibility in creating laminates, and thus enclosures, of different forms. Using a "standard" core portion 36 the sizes and locations of the extension portions may be varied relatively easily. This may be achieved by simply altering the lengths of the lines 42, 44 which extend between the portions 36, 38 and thus allowing an alteration of the width of the area between the portions 36, 38. The spacing between the edge of the sheet and the lines of the extension portion may also be varied.

The provision of the extension portions 38 also permits coverage of irregular, notably non-rectangular areas, without varying the configuration of the core portion 36 or varying the configuration of electrical connections to the matrix 45, as will be described. The extension portions 38 may also be used to leave areas free of lines 42, 44, such that these areas may be slit to facilitate folding to form the enclosure, and also to facilitate corner formation in the enclosure. If reference is made to FIG. 2, it will be noted that the fold lines 52 divide the corners of the laminate 34 into triangular portions 76, and one of each triangular portion 76 is provided free of lines 42, 44.

Figure 8B:
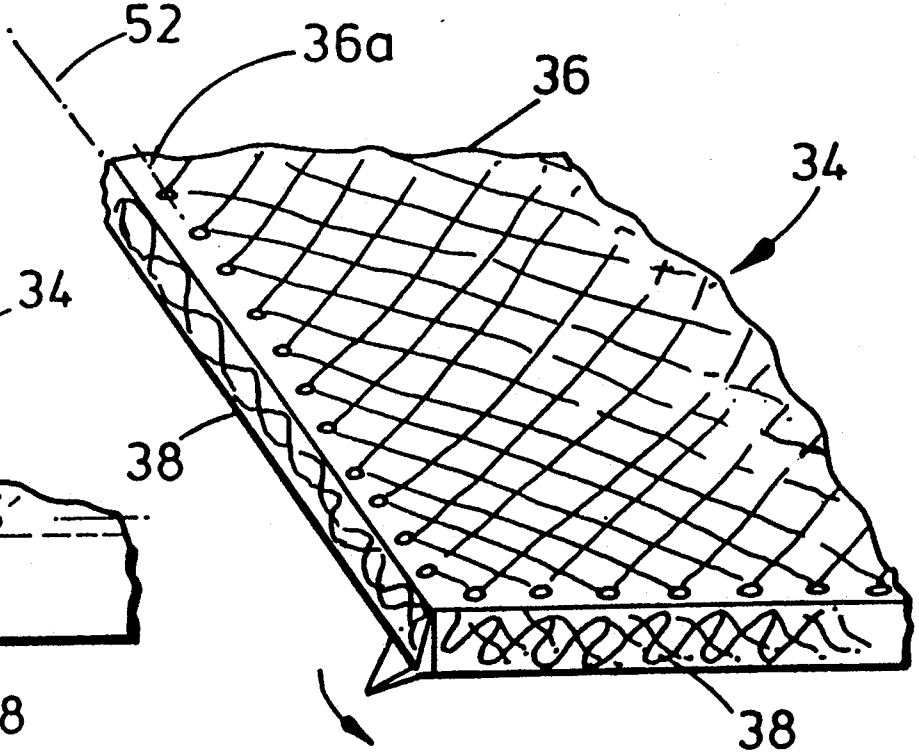
FIG. 8*a* and 8*b* are a view of a corner of the laminate of FIG. 2 and a view of the corner after folding, respectively, shown enlarged.
Figure 8A:
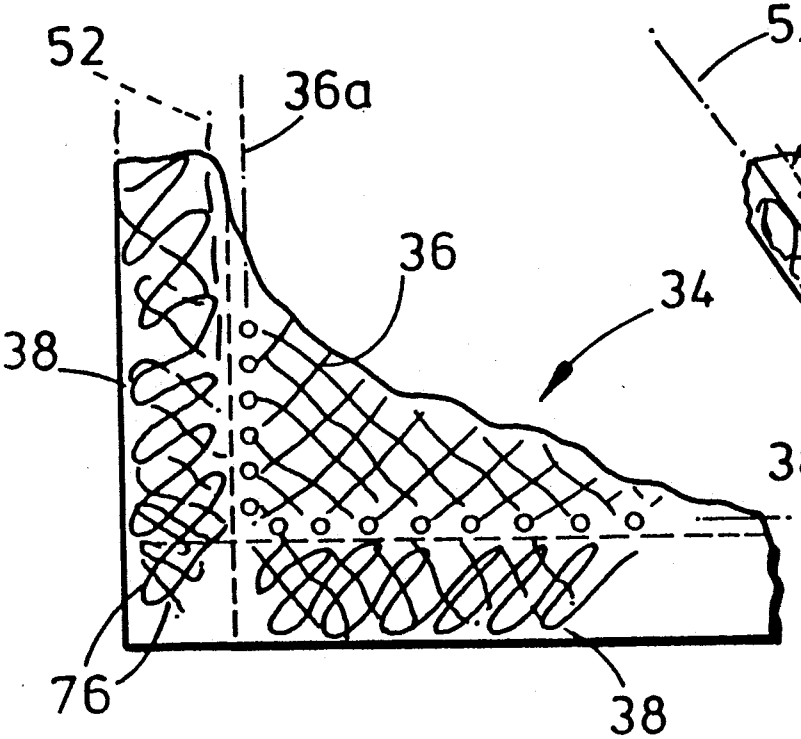

A corner of the laminate 34 is shown in greater detail in FIGS. 8*a* and 8*b* of the drawings. When the laminate is folded to form the enclosure the corners are folded inwardly (or outwardly), as seen in FIG. 8*b*, ensuring that there is a layer of laminate 34 carrying lines 42, 44 across the corners of the enclosure 20.

Other features of the laminate 34 and enclosure 20 will now be described. As mentioned above, the various lines 42, 44 are connected to form a number of continuous conductors, and in this example the laminate is provided with four conductors, each of the same electrical length. Monitoring of the conductors is achieved by monitoring the voltage or potential drop between the two ends of each conductor. In order to penetrate the sheet without affecting the lines 42, 44, and thus the voltage drop across the conductors, it would be necessary to first identify the lines which define each loop and then tap across sections of the lines to produce a hold of sufficient size to gain useful entry to the enclosure. In the preferred embodiment, further means are provided for detecting penetration of the laminate, as will be described with reference to FIG. 9 of the drawings, following a brief description of the preferred laminate construction.

Typically, the pads 46 are spaced to produce a matrix of diamond shaped areas of largest dimension no more than 10 mm. Also, the sheet and lines are further overprinted with a layer of non-conductive ink (not shown), the same colour as the semi-conductive ink used to form the lines 42, 44 so as to conceal the matrix. It is preferred that carbon is used to provide the semi-conductive properties of the matrix, since it is most easily concealed to sophisticated investigation techniques such as X-ray examination. Preferred materials are polyester film for the thin insulating sheet 40, 0.025 mm or less thick, and carbon filled polyester adhesive for the lines 42, 44 and pads 46, applied by screen printing. Typically, the lines 42, 44 are no more than 1 mm wide and pads 46 may be 1.5 mm or smaller in diameter. The carbon will be selected to produce low resistivity for low volume filling. Typically, a track may be formed with resisitivity of 6 ohms-cm for a 25% carbon loading in polyester.

The overprinting layer (not shown) would also be a carbon loaded polyester film. In this case the carbon would be chosen to produce high colour (jetness) with low loading and minimum change to electrical resistance. Typically a resistivity higher than $10^{13}$ ohms-cm can be achieved by 2 percent loading whilst providing good jetness.

Figure 9A:
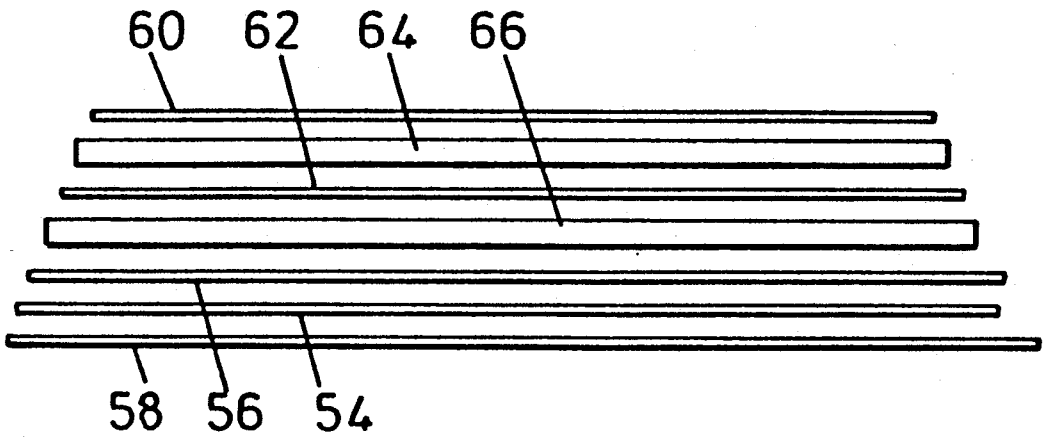
FIGS. 9*a* and 9*b* are an exploded side view and a side elevation, respectively, of the flexible laminate of FIG. 2.
Figure 9B:
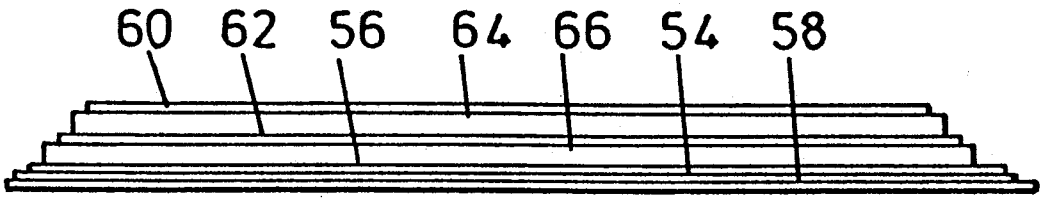

The laminate for forming the walls of a preferred security enclosure also includes a number of additional layers, as will now be described with reference to FIGS. 9*a* and 9*b*, and also subsequently with reference to FIG. 10 of the drawings. The flexible sheet 40 carrying the lines 42, 44 and the overprinting layers is represented by layer 54 which is sandwiched between two thin insulating films 56, 58, for example of polyester. The upper portion of the sheet comprises two further thin insulating films 60, 62 and two layers 64, 66 of semi-conductive fibrous material.

Each semi-conductive layer 64, 66 is made throughout of a fibrous material such that, in use, when a sharp object penetrates the layers the object will pull fragments of the outer semi-conductive layer 66 through the intervening insulating layer 60 to touch, and to make electrical contact with, the inner semi-conductive layer 64. In order to have a high probability of a conductive path being formed, the insulating layer 60 should be thinner than the mean length of the conductive fibers produced by pushing an object through the semi-conductive layer. Preferably, the insulating layer 60 should be no thicker than, and preferably thinner than, the semi-conductive layers. Typically the thickness of the semi-conductive layers 64, 66 may be 0.05 mm, and the thickness of the insulating layers 56, 60, 62 may be no more than 0.025 mm. The preferred semi-conductive fibrous material is unsintered, carbon loaded polytetrafluoroethylene (PTFE) having a volume resistivity of typically from 1 to 10 ohms-cm, and the preferred insulating material is polyester film.

Figure 10:
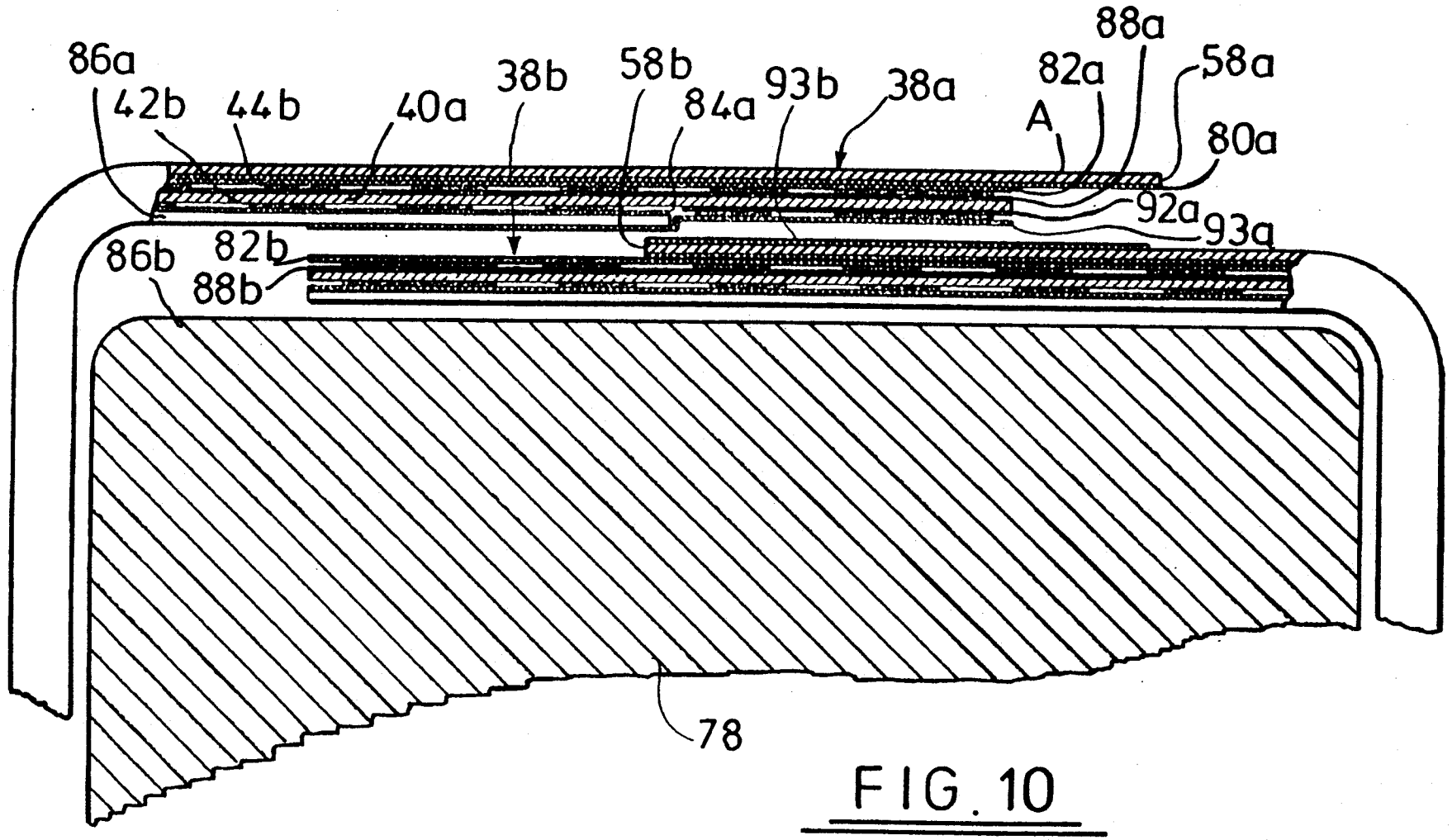
FIG. 10 is a sectional view showing edge portions of laminate joined together to form a wall of an enclosure.

FIG. 10 of the drawing shows two overlapping extension portions which have been joined to form a wall of an enclosure. The reference numerals used in relation to the upper overlapping portion (as viewed in FIG. 10) will generally be suffixed with the letter "a", while the reference numerals used in relation to the lower portion will generally be suffixed with the letter "b". The drawings also shows an object 78 within the enclosure 20. The thickness of various ones of the layers have been exaggerated for clarity, and the adhesive layers 80. 82, 84 between the lines 42*a*, 44*b* have been shown however, the semi-conducting fibrous layers are shown "compressed" for clarity as layer 86. It will also be noted that additional layers 88 of material are interposed between the sheet 40 and the lines 44*b* which will lie to the outside of the sheet 40 in the enclosure 20. The layers 88 are formed of low tensile strength material having lower cohesion than adhesion. The layers may comprise an ethyl vinyl acetate (EVA) having high vinyl acetate (VA) content, for example 70% VA, also filled to 45%-60% (by weight) with fumed silica (typically having particle size of 12 mm and 20 $m^2/g$ surface area). It is also preferred that the material contains a black pigment such that the carbon loaded semi-conductive lines 42, 44 are not easily visible of the layer 88.

The adhesive layers 80, 82, 84 are formed of pressure sensitive, heat reflowable adhesive, preferably a high VA content EVA, for example 70% of VA and also pigmented black. The upper overlapping extension portion 38*a* has the insulating film 58*a* extending beyond the edge of the sheet 40*a* to form a flap A. The underside of the flap A is provided with an adhesive layer 80A, which is utilised to secure the flap A to the overlapping extension portion 38*b*.

The layer 86*a* does not extend to the edge of the sheet 40*a* and at the "exposed" inner face of the sheet 40*a*, and edge layer 92*a* of low tensile strength material is provided below the conductive lines 42*b*. An additional layer 93*a* of adhesive is provided over the exposed lines 42*b* and continues over the edge of the inner face of the layer 86*a*.

On the overlapping extension portion 38*b*, the upper insulating film 58*b* does not extend to the edge of the laminate, leaving a portion of adhesive layer 82*b* exposed. A further layer 93*b* of adhesive is provided on the edge of the film 58*b*.

The overlapping portions 38*a*, 38*b* are brought together and the various layers of adhesive 80*a*, 93*a*, 93*b*, 82*b*, which come into contact become homogeneous over a period of time to provide a secure join. If any attempt is made to separate the edges, as the outer film 58*a* is peeled back, one or more of the low tensile strength layers 88*a*, 92*a*, 88*b*, will fragment, breaking the lines 42, 44.

Figure 11:
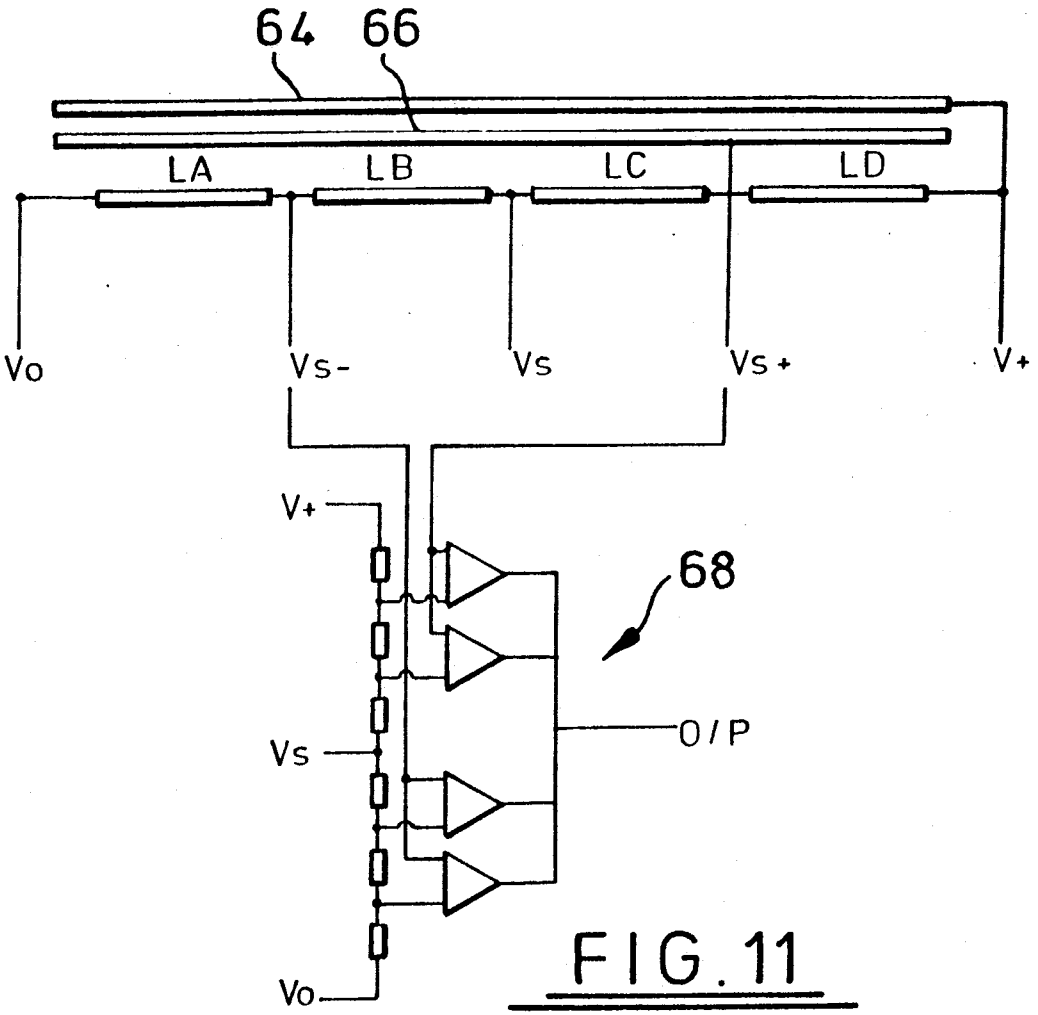
FIG. 11 is a diagram of a circuit for use with the security enclosure of FIG. 1.

FIG. 11 of the drawings illustrates the preferred circuit which provides the means for detecting changes in the electrical characteristics of the laminate. The semi-conductive layers 64, 66 are shown and the blocks LA, LB, LC, LD represent the four conductors formed by the lines 42, 44 printed on the sheet 40. The conductors are connected in series between reference potentials and connections are made between each conductor and a comparator circuit 68 which is set to detect any change in the monitored potentials. Any penetration of the semi-conductive layers 64, 66 or damage to the conductors LA, LB, LC, LD will result in a change in the monitored potentials, creating an output from the comparator circuit 68 which may be passed to a suitable amplifier to activate an alarm or initiate some other appropriate action.

The connections between the conductors and the comparator circuit 68 may be made directly from an edge of either the core portion 36 or one of the extension portions 38. However, to provide a more secure enclosure it is preferred that the configuration of connections between the comparator circuit 68 and the conductor may be readily varied by the manufacturer, and also that a configuration of the conductors on the sheet 40 may be varied. The configuration which provides these features will now be described with reference to FIG. 12 of the drawings. It should be noted that this configuration is described and explained in somewhat more detail in applicants earlier filed co-pending application, also entitled Improvements in Security Enclosures.

Figure 12:
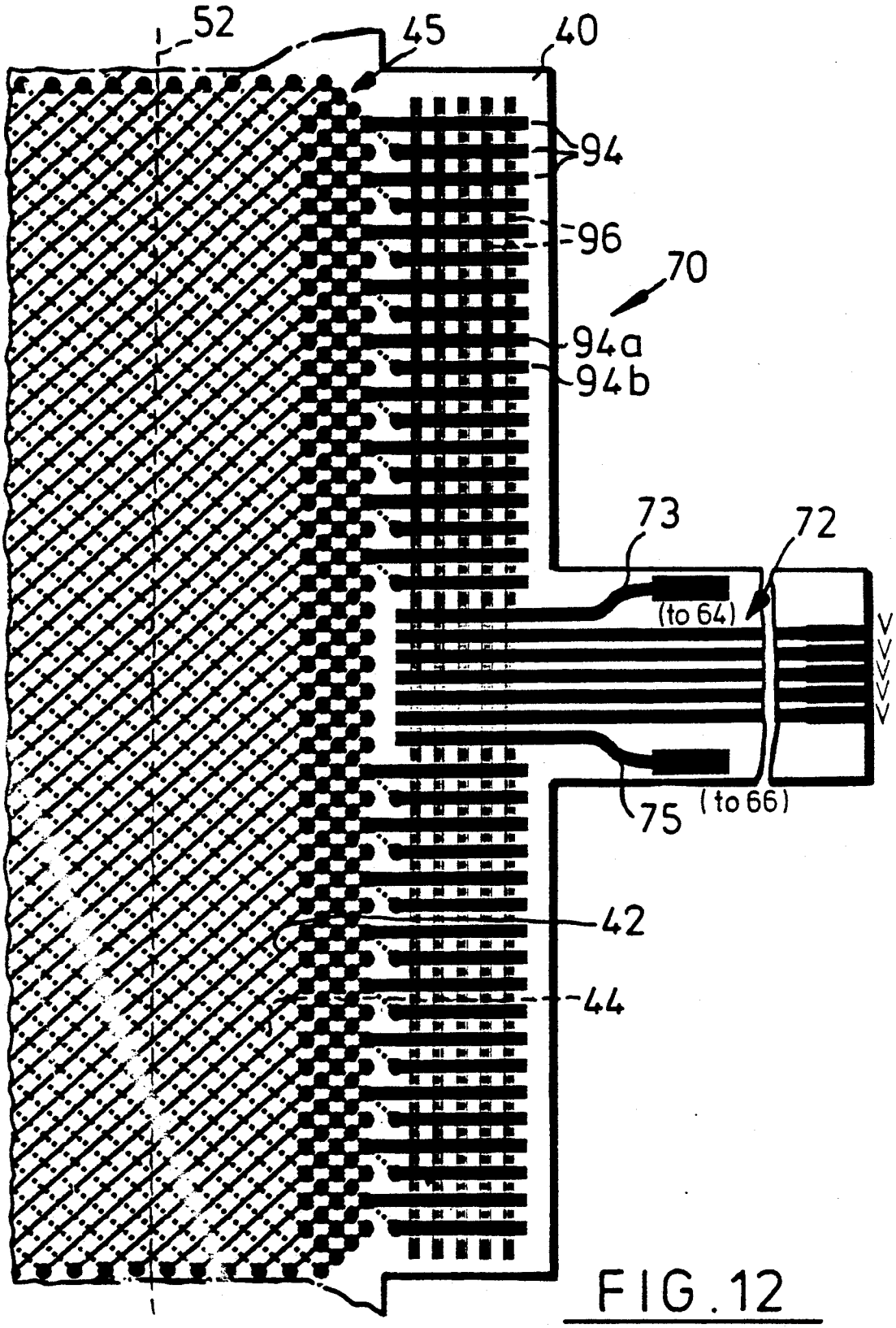
FIG. 12 is an enlarged view of an edge portion of the laminate of FIG. 2.

FIG. 12 illustrates the edge of the laminate which will be folded to from the end wall 32 of the enclosure 20. It will be noted that each line 42, 44 is provided with five pads at the edge of the core portion 36, and that no extension portion 38 is provided. The provision of five pads allows selected pads to be apertured during manufacture of the sheet to provide conductors of particular configuration. Further, the connection between the laminate and the comparator circuit 68 is illustrated and is in the form of connecting means in the form of a matrix of conducting paths 70 which are connected to connectors 72 for linking with the comparator circuit.

The conducting paths 70 comprise, with reference to this particular illustration, a series of longitudinal paths 94 on the upper surface of the sheet 60 and a series of lateral paths 96 on the underside of the sheet. The lateral paths 96 pass beneath the connectors 72 and electrical connection between selected ones of the connectors 72 and the lateral conducting paths 96 are made in the same manner as the connections at the pads, that is by forming a hole through the sheet at the intersection of the paths 96 and connectors 72 and printing one of the tracks such that the conducting ink extends through the hole to form a connection between the tracks. Connections between the lateral paths 96 and the longitudinal paths 94 are achieved by the same means. Further connections 73, 75 are also provided on either side of the connectors 72 for providing an electrical connection between the matrix 70 of conducting paths 94, 96, the connectors 72, and the two semi-conductive layers 64, 66 of the laminate.

The longitudinal conductive paths 94 alternate between longer paths 94*a* which extend to contact the pads 98 at the extreme edge of the matrix 45 and shorter paths 94*b* which terminate in pads directly above pads provided at the ends of alternate conductive lines 44 on the underside of the sheet 40.

It will be noted that there are a great number of possible connections which may be made between the paths 94, 96 and the matrix 45. This facility allows the manufacturer to vary the connections between the matrix 45 and the paths 94, 96 and thus the connections between the matrix 45 and the connectors 72. Thus, if reference is also made to FIG. 11, each of the conductors LA, LB, LC, LD could be represented by any one of many configurations of lines 42, 44 on the sheet and thus it would be extremely difficult for an intruder to predict the path of a particular conductor, and its particular reference potentials from an examination of even a large number of enclosures provided with similar sheets.

To allow use of a similar comparator circuit 68 for each sheet produced it is necessary that the total length of each conductor, however formed on the sheet, be of similar length such that the resistance or change in potential across each conductor is the same and the conductors may therefore be "located" in any desired position relative to the comparator circuit 68.

From the above description it will be seen that the present invention provides a laminate which may be easily formed into a secure box shaped enclosure and which may thus be used to accommodate a large variety of objects of different shape.

It will be clear to those of skill in the art that the above described embodiment is merely exemplary of the present invention. The enclosure 20 described above is of a truncated wedge shape, though the laminate could equally well be formed of a shape to produce cube or cuboid-shaped enclosures.

I claim:

1. A laminate for use in forming security enclosures comprising: a flexible, electrically insulating sheet carrying lines of electrically conductive material on each side, the lines defining a conductor extending over both sides of the sheet, electrical connection between lines on one side of the sheet and respective lines on the other side of the sheet being provided by line connections located adjacent to edges of the sheet and extending through the sheet, and at least one edge of the laminate the line connections adjacent to said at least one edge being spaced inwardly from said one edge of the sheet and separated from said one edge by a line-carrying portion of sheet, an attempt to penetrate the laminate resulting in damage to the lines and changing a detectable electrical characteristics of the conductor; and means for connecting the conductor to means for detecting such changes wherein the sheet further includes a line carrying core portion completely bounded by said line connections and a line carrying extension portion at an edge of the core portion at said at least one edge of the sheet, the core portion having lines on one side of the sheet connected to lines on the other side of the core portion through said line connections and also having lines connected to lines on the extension portion.

2. The laminate of claim 1 in which the conductor is defined by a plurality of lines on one side of the electrically insulating sheet and a plurality of lines on the other side of the sheet, lines on said one side of the electrically insulating sheet being connected in series between two lines on said other side of the electrically insulating sheet by respective line connections.

3. The laminate of claim 1 in which the extension portion also has line connections between lines on one side of the extension portion and the lines on the other side of the extension portion.

4. The laminate of claim 1 in which a plurality of conductors are provided and the electrical characteristic of each conductor may be individually monitored, through the conductor connecting means.

5. The laminate of claim 1 in which the line connections are in the form of apertures extending between overlapping lines with electrically conductive material extending through the apertures to connect the lines.

6. The laminate of claim 5 in which the lines are of semi-conductive ink and the ink forms a conductive lining on the aperture walls.

7. The laminate of claim 1 in which said edge of the core portion is straight to facilitate folding of the sheet between the core and extension portions.

8. The laminate of claim 7 wherein extension portions are provided at a plurality of edges of the core portion and at least the core portion is rectangular.

9. The laminate of claim 1 wherein the lines on one side of the sheet extend obliquely relative to the lines on the other side to divide the sheet into a number of relatively small areas.

10. A security enclosure comprising: a flexible, electrically insulating sheet defining a plurality of folds and extending over the whole of the area of the enclosure and carrying lines of electrically responsive material on each side, the lines defining a conductor extending over both sides of the sheet, electrical connections between lines on one side of the sheet and respective lines on the other side of the sheet provided by line connections located adjacent to edges of the sheet and extending through the sheet and at least of one or more selected edges of the sheet the respective line connections adjacent to each selected edge being spaced inwardly of the edge and separated from the edge by a respective line-carrying portion of sheet; means for detecting a change in an electrical characteristic of the conductor caused by an attempt to penetrate the sheet; and means for connecting the conductor to the detecting means wherein the sheet includes a line carrying core portion completely bounded by said line connections and line carrying extension portions at respective edges of the core portion at said one or more selected edges of the sheet, the core portion having lines on one side of the sheet connected to lines on the other side of the core portion through line connections and also having lines connected to lines on the extension portions, and at least some of the extensions portions being overlapped and joined to complementary portions of the sheet to define the enclosure.

11. The security enclosure of claim 10 in which the conductor is defined by a plurality of lines on one side of the electrically insulating sheet and a plurality of lines on the other side of the sheet, lines on said one side of the electrically insulating sheet being connected in series between two lines on said other side of the electrically insulating sheet by respective line connections.

12. The enclosure of claim 10 in which each extension portion also has line connections between lines on one side of the extension portion and the lines on the other side of the extension portion.

13. The enclosure of claim 10 in which at least some of the folds in the sheet are formed between the edges of the core portion and adjacent extension portions and the number of lines crossing the folds is relatively small.

14. The enclosure of claim 10 in which the lines provided at outer edges of the extension portions are relatively fragile to facilitate detection of attempts to gain entry to the enclosure by separation of an extension portion from a complementary overlapping portion.

15. The enclosure of claim 10 in which a plurality of conductors are formed by the lines and the conductor connecting means are provided at an edge portion of the sheet for individually connecting the conductors to the detecting means.

16. The enclosure of claim 15 in which the connecting means includes switch means selectively configured to connect connections associated with the detecting means with selected conductors.

17. The enclosure of claim 10 wherein one edge portion of the sheet includes a plurality of line switch means which are selectively configured to connect each one of the lines on one side of the sheet with a selected one of a plurality of lines on the other side of the sheet.

18. A method of forming a security enclosure comprising:

providing a flexible, electrically insulating sheet carrying lines of electrically responsive material on each side, the lines defining a conductor extending over both sides of the sheet, electrical connections between lines on one side of the sheet and respective lines on the other side of the sheet being provided by line connections extending through the sheet, the sheet including a line carrying core portion completely bounded by said line connections and line carrying extension portions, each extension portion defining an edge of the sheet and at selected edges of the core portion the line connections adjacent to said selected edges being spaced inwardly of the respective adjacent edge of the sheet and separated from said adjacent edge by a respective extension portion;

providing means for detecting a change in an electrical characteristic of the conductor caused by an attempt to penetrate the sheet;

providing means for connecting the conductor to the detecting means;

folding the sheet between the core portion and the extension portions to form an enclosure and such that respective edge portions of the sheet overlap; and fixing the overlapping edge portions of the sheet to one another.

* * * * *